United States Patent [19]

Wasserman

[11] 4,122,924

[45] Oct. 31, 1978

[54] WHEEL SUPPORTED LUGGAGE

[76] Inventor: David Wasserman, 1926 Cole Dr., East Meadow, N.Y. 11554

[21] Appl. No.: 819,759

[22] Filed: Jul. 28, 1977

[51] Int. Cl.[2] ..... A45C 5/14
[52] U.S. Cl. ..... 190/18 A; 280/37
[58] Field of Search ..... 190/18 A, 18 R; 280/37, 280/43, 43.24, 47.34

[56] References Cited

U.S. PATENT DOCUMENTS

| | | | |
|---|---|---|---|
| 228,916 | 6/1880 | McCall | 280/43 |
| 2,917,317 | 12/1959 | Denholm | 190/18 A X |
| 2,925,283 | 2/1960 | Stilger | 280/37 |
| 3,178,197 | 4/1965 | Boatner | 280/37 |

*Primary Examiner*—Donald F. Norton
*Attorney, Agent, or Firm*—Robert D. Farkas

[57] ABSTRACT

A valise or suitcase utilizes a self supporting, height adjustable, wheeled undercarriage, which when not in use is concealed in an open-bottomed compartment at the base of the suitcase.

8 Claims, 4 Drawing Figures

WHEEL SUPPORTED LUGGAGE

BACKGROUND OF THE INVENTION

1. The Field of the Invention

This invention relates to wheeled, supported, portable containers, and more particularly to that class having concealable undercarriages.

2. Description of the Prior Art

The prior art abounds with suitcases equipped with wheels. U.S. Pat. No. 2,472,491 issued on June 7, 1949 to B. Quinton, and U.S. Pat. No. 2,577,951 issued on Dec. 11, 1951 to E. J. Cortsen, and U.S. Pat. No. 2,925,283 issued on Feb. 16, 1960 to A. J. Stilger and U.S. Pat. No. 3,057,636 issued on Oct. 9, 1962 to A. J. D'Ettorree et al each suffer the common deficiency of providing only two wheels as a means for support, rather than a self supporting undercarriage.

U.S. Pat. No. 3,178,197 issued on Apr. 13, 1965 to C. Botner describes a rollalong luggage device which provides casters on a self supporting retractable carriage, and having height adjustable grip means. This patent however, fails to teach locking and release means for the undercarriage.

SUMMARY OF THE INVENTION

A primary object of the present invention is to provide a self supporting wheeled portable container enabling the user thereof to adjust the height of the enclosure with respect to a supporting surface.

Another object of the present invention is to provide suitable locking means in order to enable the user thereof to fix the height of the container with respect to the supporting surface in order to prevent stooping over when wheeling as is so often the case with other wheeled arrangements.

Still another object of the present invention is to provide a handle with a manually operated actuating means in order to enable the user to release or retain the self supporting undercarriage in any downwardly extended position while holding the handle.

Yet another object of the present invention is to provide a means for concealing the self supporting undercarriage when not in use.

When stopping on an incline, simple retraction of the self supporting undercarriage will allow the user to rest the enclosure on the ground eliminating the enclosure's tendency to "run away."

These objects, as well as other objects of the present invention, will become more readily apparent after reading the following description of the accompanying drawings.

DESCRIPTION OF THE PREFERRED EMBODIMENT

The structure and method of fabrication of the present invention is applicable to a suitcase having a generally rectangular casing composed of two body side portions. The side portions may be hinged at one marginal edge and secured at the other edge thereof as by means of suitable clasps or locks. When the two portions are closed two separated compartments are defined. One is an interior storage compartment, the other being an open bottomed compartment for concealing a wheeled undercarriage. Handles may be provided at the top or on one side of the body portions.

Each body side portion houses a U-shaped bar, to which the ends of wheels or casters are affixed, and two legs which ride up and down in snug fitting channels concealed in the side walls of each side body portion. The U-shaped bar contains a series of holes drilled horizontally in the side surfaces of the legs which allow lock pins, mounted to a release bar, to be inserted therein. Each U-shaped bar and associated wheels form half of a self supporting undercarriage, such that both of the U-shaped bar and wheel assemblies may ride up and down, in concert, having the same vertical displacement from both body side portions, permitting the suitcase, when closed, to be raised or lowered relative to the supporting surface, when supported thereby.

A locking means may be provided preferably consisting of a spring loaded actuating button, flush mounted in the handle mounted to each side portion. A release bracket assembly may be mounted to each actuating button such that depression of the actuating button causes inward movement of the release bracket assembly relative to the walls of the side body portion. The release bar is fitted with two of the lock pins, mounted such that when the actuating button is depressed inwardly in the handle, the lock pins are removed from the holes in the legs. Removing pressure from the actuating buttons re-engages the release bracket lock pins into the holes in the legs. Thus, the self supporting undercarriage is locked in a fixed position with respect to the body portions of the suitcase, and hence the suitcase is positioned at a fixed height relative to the supporting, surface, upon which the wheels rest.

Figure 1:
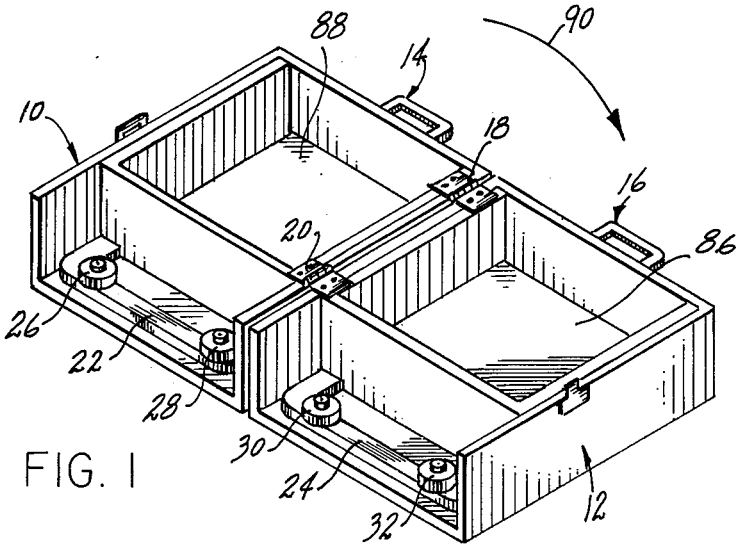
FIG. 1 is a perspective view of the present invention, shown in an opened state.

Now referring to the Figures and more particularly to the embodiment illustrated in FIG. 1 showing the body side portions 10 and 12 respectively, having hinges 18 and 20 joining the side portions, handles 14 and 16, U-shaped bars 22 and 24, on which are mounted wheels 26, 28, 30 and 32. The wheels may, if desired, be free turning casters. Five sided compartments 86 and 88 are located in body side portions 10 and 12 respectively. When side 10 is pivoted in the direction of arrow 90, a storage space or sealed compartment is evolved.

Figure 2:
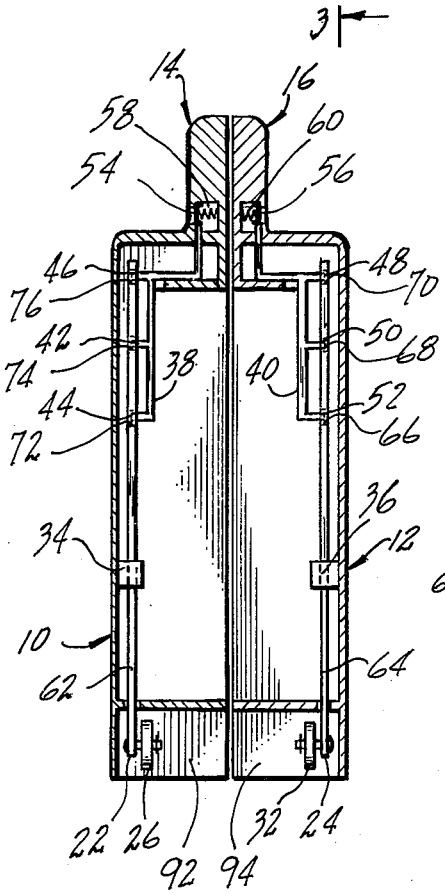
FIG. 2 is a side elevation cross-section view of the present invention when closed.

FIG. 2 illustrates body side portions 10 and 12 folded such that the handles 14 and 16 are in contact thus allowing the invention to be hand carried. U-shaped bars 22 and 24, with wheels 26 and 32 are shown such that the vertically disposed leg portions 62 and 64 thereof are concealed in snug fitting channels 34 and 36. Release bars 38 and 40, containing lock pins 42, 44, 46, 48, 50 and 52 are shown engaging holes 66, 68, 70, 72, 74 and 76. Push buttons 54, and 56 are mounted in handles 14 and 16. Open bottom compartments 92 and 94 conceal wheels 26 and 32, as shown. Springs 58 and 60 are mounted in handles 14 and 16 biasing push buttons 54 and 56 towards the outer vertical surfaces of side portions 10 and 12. Push buttons 54 and 56 are secured to release bars 38 and 40.

Figure 3:
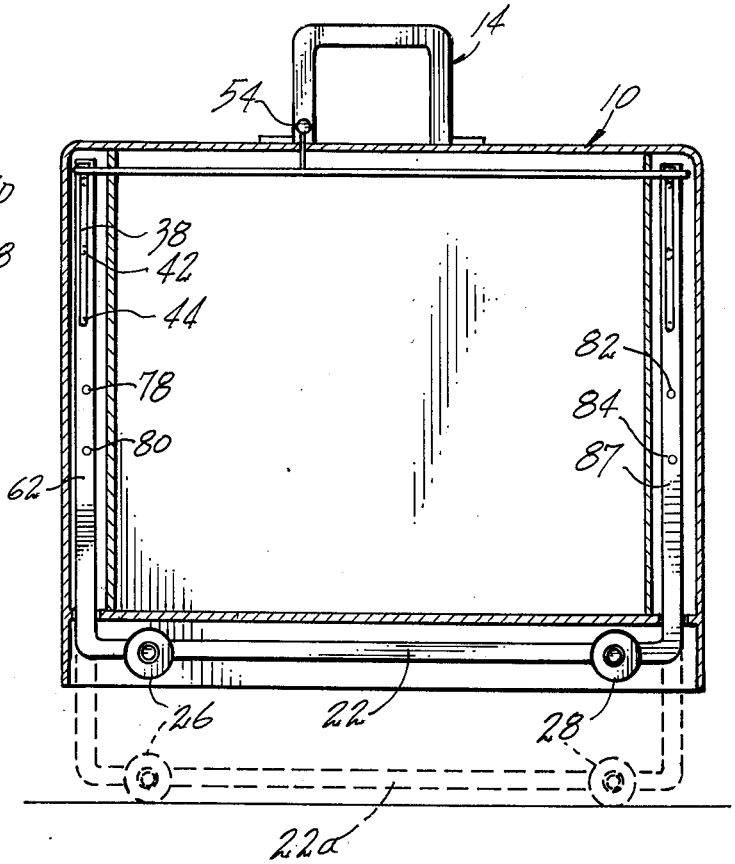
FIG. 3 is a side elevation cross-sectional view taken along lines 3—3 and viewed in the direction of arrows 3—3 of the present invention illustrated in FIG. 2.

FIG. 3 illustrates the present invention having U-shaped bar 22, shown in the concealed position and in an extended position by dotted lines **22*a*. Release bar 38** is shown engaged in vertical legs 62 and 86 of U-shaped bar 22. Holes 78, 80, 82, and 84 are shown drilled in legs 62 and 87.

Figure 4:
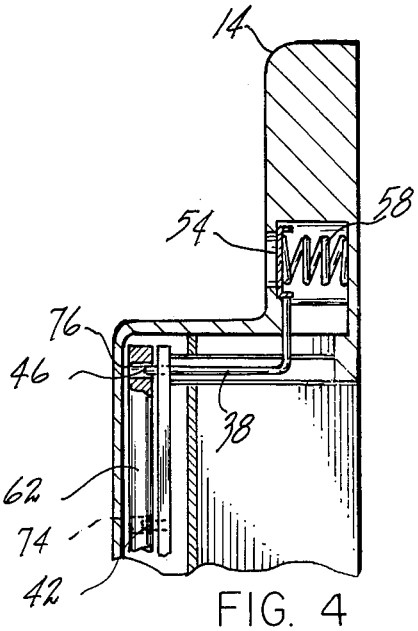
FIG. 4 is an enlarged fragmentary view of a portion of the device shown in FIG. 2.

FIG. 4 illustrates push button 54, being contacted by spring 58, both being enclosed in handle 14. Push button 54 is connected to release bar 38 having pins 42 and 46 secured thereto and engaged in holes 74 and 76 located in vertical shaft 62.

One advantage of the present invention is a self supporting wheeled portable container enabling the user thereof to adjust the height of the enclosure with respect to a supporting surface.

Another advantage of the present invention is a suitable locking means in order to enable the user thereof to fix the height of the container with respect to the supporting surface in order to prevent stooping over when wheeling as is so often the case with other wheeled arrangements.

Still another advantage of the present invention is a handle with a manually operated actuating means in order to enable the user to release or retain the self supporting undercarriage in any downwardly extended position while holding the handle.

Yet another advantage of the present invention is a means for concealing the self supporting undercarriage when not in use.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

1. A wheel supported luggage apparatus comprising a pair of body portions, each of said pair of body portions being pivotably secured to one another, said each body portion having a compartment therein, said compartment having an open mouth portion, the open mouth portion of said each body portion being disposed in juxtaposed touching relationship when said each body portions are pivoted into a closed condition, said each body portion having an additional compartment therein, said additional compartment being located separated from said compartment, said additional compartment of each said body portion being disposed in aligned relationship with each other when said body portions are disposed in said closed condition, said each additional compartment having an open mouth portion disposed perpendicular to said open mouth portion of said compartment when said body portions are disposed in said closed condition, a pair of U-shaped bars, the legs of said pair of U-shaped bars being disposed in parallel spaced apart relationship and extending parallel to said open mouth portion of said compartments, said U-shaped bars carrying wheels, said wheels rotatably secured to said U-shaped bars along a portion thereof intermediate said legs, said portions of said U-shaped bars being disposed residing in said additional compartments, means to slidably secure said legs to said body portions, said portions of said U-shaped bars being movable outwardly of said additional compartment, means to selectively releasingly engage each said U-shaped bar in selected locations along the slidable path thereof.

2. A wheel supported luggage apparatus as claimed in claim 1 further comprising handles, each said handle carried by one of said pair of body portions, said handle being located on a portion of the exterior surface of said one of said pair of body portions at a location opposite to said open mouth portion of said additional compartment.

3. The wheel supported luggage apparatus as claimed in claim 2 wherein said means to releasingly lockingly engage said U-shaped bar comprises a release bar, a portion of said release bar being disposed in parallel spaced apart relationship with said legs, a plurality of pins, said plurality of pins fixedly secured to said release bar and extending outwardly therefrom, said legs having a plurality of holes, said plurality of pins being disposed and biased toward said plurality of holes, a pushbutton, said pushbutton being fixedly secured to another portion of said release bar wherein operating said pushbutton causes said release bar to move inwardly from said legs of said U-shaped bar.

4. The wheel supported luggage apparatus as claimed in claim 3 further comprising springs, each said spring being located in a handle, one end of said spring contacting said pushbutton, the other end of said spring being disposed in touching engagement with said handle, wherein said spring causes said pushbutton to be biased outwardly towards an exterior surface of said handle in an opposite direction from the location of said other end of said spring.

5. The wheel supported luggage apparatus as claimed in claim 1 wherein said pair of body portions are hingably secured to one another along a line extending normal to said open mouth portion of said additional compartment.

6. The wheel supported luggage apparatus as claimed in claim 1 wherein said legs of each of said U-shaped bars are separated by a wall from an adjacent said compartment, said wall extending along a plane parallel to the longitudinal axis of said legs.

7. The wheel supported luggage apparatus as claimed in claim 1 wherein each of said pair of body portions carries locking means for releasably locking together each of said pair of body portions when said pair of body portions are in said closed condition.

8. The wheel supported luggage apparatus as claimed in claim 1 wherein said portion of said each of said U-shaped bars carries a pair of said wheels.

* * * * *